US011821186B2

(12) United States Patent
Onodera et al.

(10) Patent No.: US 11,821,186 B2
(45) **Date of Patent: *Nov. 21, 2023**

(54) SPOUT APPARATUS

(71) Applicant: TOTO LTD., Kitakyushu (JP)

(72) Inventors: Rie Onodera, Kitakyushu (JP); Ryohei Yaita, Kitakyushu (JP); Shunji Yoshino, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/579,097

(22) Filed: Jan. 19, 2022

(65) Prior Publication Data

US 2022/0136222 A1 May 5, 2022

Related U.S. Application Data

(63) Continuation of application No. 16/260,489, filed on Jan. 29, 2019, now Pat. No. 11,261,586.

(30) Foreign Application Priority Data

Mar. 1, 2018 (JP) ..... 2018-036593

(51) Int. Cl.
*E03C 1/04* (2006.01)
*E03C 1/084* (2006.01)
*B05B 1/34* (2006.01)

(52) U.S. Cl.
CPC ..... *E03C 1/0404* (2013.01); *B05B 1/34* (2013.01); *E03C 1/084* (2013.01)

(58) Field of Classification Search
CPC ..... E03C 1/0404; E03C 1/084
(Continued)

(56) References Cited

U.S. PATENT DOCUMENTS 2,715,045 A * 8/1955 Thompson ..... B01F 25/316 261/78.2
11,261,586 B2 * 3/2022 Onodera ..... E03C 1/084

FOREIGN PATENT DOCUMENTS

JP S61-283316 A 12/1986
JP 9-313989 A 12/1997
(Continued)

OTHER PUBLICATIONS

Notice of Reasons for Refusal issued in Japanese Patent Application No. 2020-004093 dated May 10, 2022, with English translation.

*Primary Examiner* — Christopher S Kim
(74) *Attorney, Agent, or Firm* — BakerHostetler

(57) ABSTRACT

Summary Problem: To provide a spout apparatus in which sagging of the mesh structure portion in the flow-conditioning member due to water pressure can be suppressed even if the flow-conditioning member is formed by a fine diameter mesh structure, and the flow-conditioning member can be compactly constituted and flow velocity distribution made uniform.

Solution Means: The embodiment of the invention is a spout apparatus 2, including a spout apparatus main unit 6, a flow-conditioning member 12, and a spray member 16; wherein the flow-conditioning member 12 is formed by a mesh structure in which numerous fine holes are formed, and the mesh structure is layered and formed three dimensionally, such that the mesh structure portion of at least a portion of the mesh structure extends in a direction parallel to the direction of water flowing into the flow-conditioning member.

4 Claims, 8 Drawing Sheets

(58) Field of Classification Search
USPC ..... 239/542
See application file for complete search history.

(56) References Cited

FOREIGN PATENT DOCUMENTS

| | | | |
|---|---|---|---|
| JP | 2006-212611 | A | 8/2006 |
| JP | 2010-209549 | A | 9/2010 |
| JP | 5168708 | A | 3/2013 |
| JP | 2014-206018 | A | 10/2014 |
| JP | 2016-75081 | A | 5/2016 |

* cited by examiner

20

22a
Or
22b

G
22b(22a)
Layering
H
24
Or
G(L)

Compression Molding
26
12

SPOUT APPARATUS

CROSS-REFERENCE TO RELATED APPLICATIONS

This application claims benefit of and is a continuation of U.S. patent application Ser. No. 16/260,489, filed Jan. 29, 2019, which claims priority to Japanese Patent Application No. 2018-036592, filed Mar. 1, 2019, the disclosures of which are incorporated by reference in their entireties.

TECHNICAL FIELD

The present disclosure relates to a spout apparatus, and more particularly relates to a spout apparatus for spouting supplied water in a shower form.

BACKGROUND ART

A spout apparatus as a ceiling-recessed shower is proposed, as shown in Patent Document 1 (JP-A-2014-206018). This spout apparatus has a flow-conditioning chamber with a plurality of flow-conditioning mesh sheets. Passing water supplied from a water supply source through a plurality of flow-conditioning meshes results in uniform of velocity vectors in the direction of passage, so that spouted water has a beautiful linear form from the spout hole portion.

SUMMARY OF THE INVENTION

Technical Problem

The inventors undertook extensive research efforts to achieve a beautiful linear water form from spout with a spout apparatus for spouting water in a shower form from a plurality of fine spray holes.

For example, a shower device having multiple spray holes is known as shown in Patent Document 2 (JP5168708). In this shower apparatus, supplied water flows into a casing, and that inflowing water then passes through a single flow-conditioning mesh disposed inside the casing. Water flow conditioned by the flow-conditioning mesh is discharged as a shower from a plurality of spray holes formed in a spray plate disposed on the downstream side of the flow-conditioning mesh.

The present inventors attempted to realize a beautiful straight line water spouting form from a plurality of spray holes by placing a plurality of flow-conditioning meshes in a shower apparatus as shown in Patent Document 2. The problem arose, however, that notwithstanding the placement of a plurality of flow-conditioning meshes, water discharged from a plurality of spray holes immediately changed into droplets in a short distance, preventing the achievement of a beautiful water form from the spout.

The present inventors therefore continued their earnest research and discovered that eddy currents generated by the circling flow of water to the rear side of the flow-conditioning mesh when the water collides with the flow-conditioning mesh disturbs the flow velocity distribution of water in the flow-conditioning chamber. Since eddy currents occur immediately after water collides with the flow-conditioning mesh, inventors considered suppressing the disturbance of the flow velocity distribution induced by eddy current by designing a relatively broad spacing interval for the placement of flow-conditioning mesh sheets. However, establishing a relatively large spacing between the plurality of flow-conditioning mesh sheets requires that the flow-conditioning chamber housing the flow-conditioning mesh sheets be enlarged, resulting in a larger spout apparatus, which leads to a new problem of degraded spout apparatus design characteristics.

To suppress the effects of eddy currents without enlarging the spacing at which flow-conditioning mesh sheets are placed, the present inventors therefore further investigated the mechanism by which eddy currents occur. As a result, it was discovered that eddy currents increase in size in proportion to the diameter thickness of the line wires constituting the flow-conditioning meshes. Therefore, the inventors investigated flow-conditioning meshes formed with a finer line diameter than in the past. However, while this did reduce the size of eddy currents, the flow-conditioning mesh sagged due to weakened ability of the flow-conditioning mesh to withstand water pressure, leading to a new problem that flow velocity distribution in the flow-conditioning chamber could not be made uniform.

An embodiment of the invention was therefore undertaken to resolve the above-described problems and issues with the conventional art, and has the object of providing a spout apparatus capable of suppressing sagging of the mesh-shaped structure portion caused by water pressure in a flow-conditioning member, and of achieving a uniform flow velocity distribution in a compact flow-conditioning member configuration, even when the flow-conditioning member is formed by a mesh structure having a fine diameter of wires.

Solution to Problems

To solve the above-described problems, according to an embodiment of the invention is: a spout apparatus for spouting supplied water in a shower form, having: a spout apparatus main body forming a flow path for passing water supplied to an interior; a flow-conditioning member disposed on the flow path of the spout apparatus main body for conditioning the distribution of flow velocities of supplied water; and a spray member in which multiple holes are formed for discharging water passed through the flow-conditioning member; wherein the flow-conditioning member is formed by a mesh structure in which numerous fine holes are formed, and the mesh structure is layered and formed three dimensionally, such that the mesh structure portion of at least a portion of the mesh structure extends in a direction parallel to the direction of water flowing into the flow-conditioning member. In the invention thus constituted, the flow-conditioning member is formed by a mesh structure in which numerous fine holes are formed, and the mesh structure is layered and formed three dimensionally, such that the mesh structure portion of at least a portion of the mesh structure extends in a direction parallel to the direction of water flowing into the flow-conditioning member. The mesh shaped structure of the mesh shaped body in the flow-conditioning member can thus resist the pressure of inflowing water, and the power of the flow-conditioning member to withstand water pressure can be increased. Moreover, the flow-conditioning member is formed by layering and forming three-dimensionally a mesh structure in which numerous fine holes are formed. Thus even with a compact flow-conditioning member constitution, water flow is straightened as it efficiently passes multiple times through fine holes in a mesh structure within a relatively short distance inside the flow-conditioning member, and flow velocity distribution can be mean uniform. Thus according to an embodiment of the invention, sagging of the mesh-shaped structure in the flow-conditioning member due to water pressure can be suppressed even if the flow-conditioning member is formed by a fine wire diameter in mesh structure, and the flow-conditioning member can be compactly constituted and flow velocity distribution can be made uniform.

In an embodiment of the invention, preferably, the flow-conditioning member is formed so that the mesh structure is layered into a roll shape, and is formed by compression molding. In the invention thus constituted, when a mesh structure is formed by folding the mesh structure the mesh structure is formed at only the tip portion of the flow-conditioning member so as to extend in a direction parallel to that of inflowing water. At this time the tip portion of the flow-conditioning member has a mesh-shaped structure portion resisting a water pressure and therefore a withstand force against water pressure becomes high, whereas the center portion of the flow-conditioning member does not have a mesh-shaped structure resisting water pressure, and therefore has a low withstand force against water pressure. According to an embodiment of the invention, because the mesh structure is layered into a roll shape and then compression molded, a mesh-shaped structure portion resisting to water pressure is formed not only at the tip portion of the flow-conditioning member, but also at the center portion of the flow-conditioning meter. This enables the strength of water pressure resistance to also be increased in the center portion of the flow-conditioning member. In addition, when the mesh structure is wound into a roll shape, a problem occurs in that the thickness of the layered mesh structure increases compared to folding the mesh structure flat. According to an embodiment of the invention, the flow-conditioning member can be made compact by compression forming the mesh structure after winding mesh structure into a roll shape.

In an embodiment of the invention, preferably, the flow-conditioning member is formed by compressing the mesh structure layered into a roll shape along the axial direction of the mesh structure. According to the invention thus constituted, the rolled mesh structure is compressed along the axial direction of this mesh structure. Thus the mesh structure portions of numerous mesh structure are formed to extend in a direction parallel to the direction of inflowing water. The mesh shaped structure of the mesh shaped body in the flow-conditioning member can resist the pressure of inflowing water, and the withstand force of the flow-conditioning member to water pressure can be further increased.

In an embodiment of the invention, preferably, first holes having a first opening area and second holes having a second opening area greater than the first opening area are formed in the flow-conditioning member. The inventors of the invention discovered a new problem whereby when water collides with a flow-conditioning member, air which had been dissolved in the water, although small in volume, is deposited to form bubbles; these bubbles combine to form large bubbles, and large bubbles sticking to the flow-conditioning member disturb the flow velocity distribution. When the size of bubbles in the flow-conditioning member is greater than the size of the holes formed in the flow-conditioning member, the air bubbles become like a wall within the flow-conditioning member, and continue to accumulate, inhibiting the equalization of water flow. By contrast, according to an embodiment of the invention first holes having a first opening area and second holes having a second opening area greater than the first opening area are formed on the flow-conditioning member. Thus air bubbles which could not pass through the first holes can pass through the second holes. Lodging of relatively large air bubbles in the flow-conditioning members can thus be constrained from impeding the [effort to] achieve uniform distribution of flow velocities.

In an embodiment of the invention, preferably, in plane view, the second holes are formed in all of the four divided areas of the flow-conditioning member, which is divided by a first center line dividing equally the flow-conditioning member into left and right and by a second center line dividing equally the flow-conditioning member into front and back. In the invention thus constituted, in each of the four divided regions of the flow-conditioning member, bubbles unable to pass through the first holes are able to pass through the second holes. Lodging of large air bubbles in the flow-conditioning members can thus be further constrained from impeding the uniformization of flow velocity distributions.

In an embodiment of the invention, preferably, the number of the second holes is less than the number of the first holes. In the invention thus constituted, the number of second holes is less than the number of first holes, therefore more of the water passing through the flow-conditioning member passes through the small opening area first holes, and the flow velocity of at least a portion of the water passing through the first holes is slowed. This enables the flow velocity distribution to be more easily equalized.

An embodiment of the invention is preferably a method for manufacturing a spout apparatus comprising: a step preparing a spout apparatus main unit forming a flow path for passing water supplied to an interior, a step preparing a flow-conditioning member for conditioning the distribution of flow velocities of supplied water by positioning the flow-conditioning member, and a step preparing a spray member in which multiple holes are formed for discharging water passed through the flow-conditioning member; whereby the step preparing a flow-conditioning member further comprises: a step preparing lines forming the flow-conditioning member; a step forming a mesh structure wherein numerous fine holes are formed by the wires; a step layering the mesh structure so that mesh structure portion in at least a portion of the mesh structure extends in a direction parallel to the direction of water flowing into the flow-conditioning member; and a step forming the flow-conditioning member by three-dimensionally forming from the mesh structure layered. In a spout apparatus manufactured by such a spout apparatus manufacturing method of the invention, the flow-conditioning member is formed so that at least a part of the mesh-shaped structure of the mesh structure extends in a direction parallel to the direction of water flowing into the flow-conditioning member. The mesh structure portion in the mesh structure in the flow-conditioning member can thus resist the pressure of inflowing water, and the power of the flow-conditioning member to withstand water pressure can be increased. Moreover, the flow-conditioning member is formed by layering and forming three-dimensionally a mesh structure in which numerous fine holes are formed. Thus even with a compact flow-conditioning member constitution, water flow is conditioned as water efficiently passes multiple times through fine holes in a mesh structure within a relatively short distance inside the flow-conditioning member, and flow velocity distribution can be made uniform. Therefore, according to an embodiment of the invention, sagging of the mesh-shaped structure portion in the flow-conditioning member due to water pressure can be suppressed even if the flow-conditioning member is formed by the mesh structure having fine diameter wires; the flow-conditioning member can be compactly constituted, and flow velocity distribution can be made uniform.

Advantageous Effects of the Invention

Thus according to the spout apparatus of an embodiment of the invention, sagging of the mesh-shaped structure portion in the flow-conditioning member due to water pressure can be suppressed even if the flow-conditioning member is formed by a fine diameter mesh structure, and the flow-conditioning member can be compactly constituted and flow velocity distribution made uniform.

DESCRIPTION OF EMBODIMENTS

Figure 1:
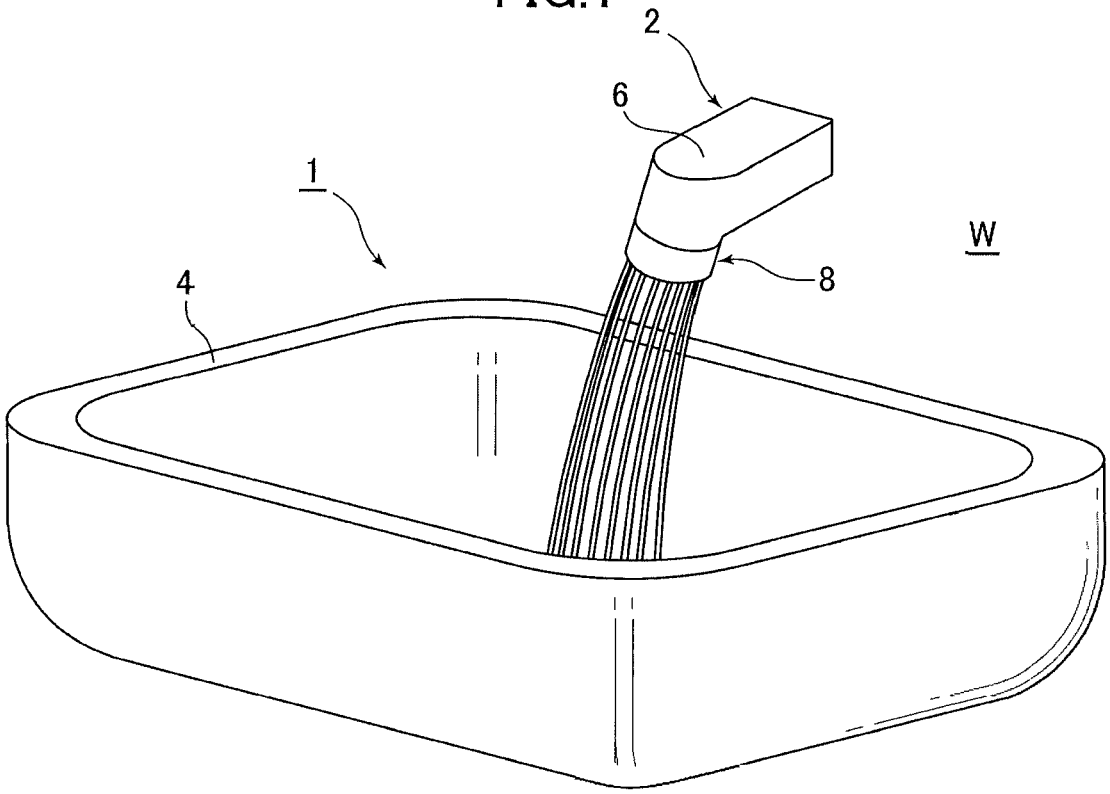
FIG. 1 is a perspective view showing the entirety of a wash basin device comprising a spout apparatus according to an embodiment of the invention.
Figure 2:
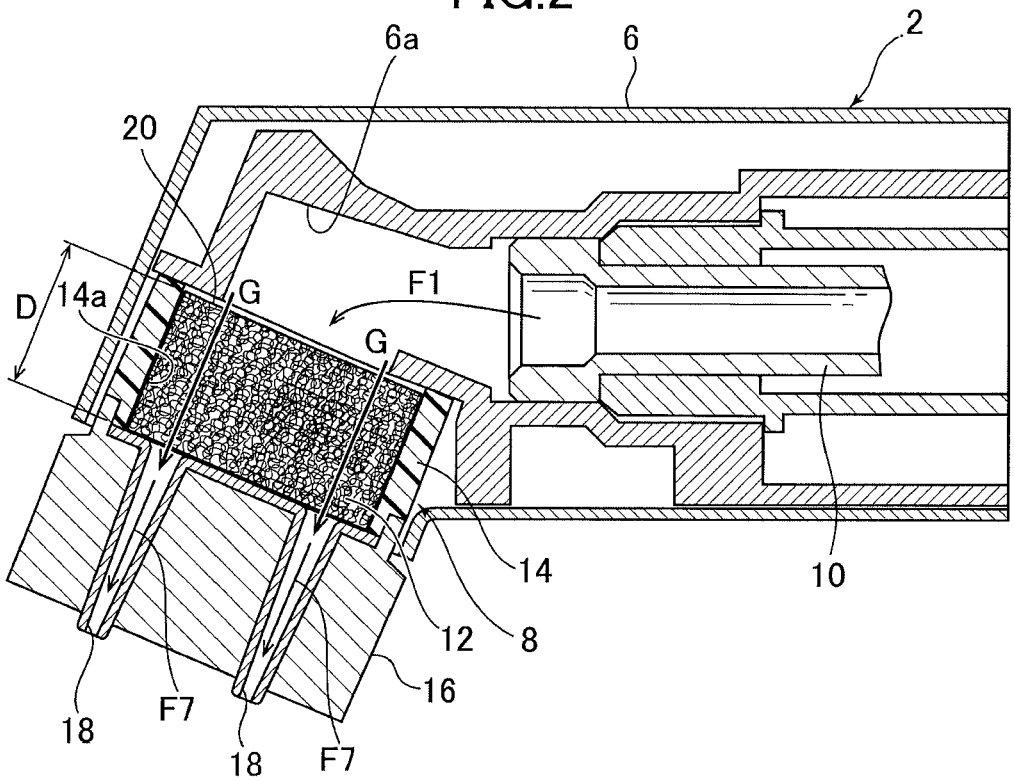
FIG. 2 is a side elevation cross section of a spout apparatus according to an embodiment of the invention.

Next, referring to the attached figures, a spout apparatus is explained according to an embodiment of the invention. FIG. 1 is a perspective view showing the entirety of a wash basin device comprising a spout apparatus according to an embodiment of the invention; FIG. 2 is a side elevation cross section of a spout apparatus according to an embodiment of the invention. As shown in FIG. 1, the wash basin device 1 has a spout apparatus 2 according to an embodiment of the invention, and a hand washing bowl 4 for receiving water discharged from this spout apparatus 2. The spout apparatus 2 spouts supplied water in a shower form. The spout apparatus 2 is not limited to being a spout apparatus for a hand washing basin; it may also be a kitchen spout apparatus or a bath spout apparatus. Note that in the present embodiment the term "water" is used in the sense of water which is water in the supplied state (for example cold water) supplied from a water supply source, hot water supplied from a hot water supply source, or mixed warm water which hot water and cold water (water) are mixed, etc. An explanation below of an embodiment of the invention refers to the side on the front of the spout apparatus 2 as seen from a user using the spout apparatus 2 (the side facing a user standing in front of the spout apparatus 2 to use the spout apparatus 2) as the front side, the side in the rear as the back side when the spout apparatus 2 is seen from the user, the side on the right as the right side when the spout apparatus 2 is seen from in front of the spout apparatus 2, and the side on the left as the left side when the spout apparatus 2 is seen from in front of the spout apparatus 2.

As shown in FIG. 2, the spout apparatus 2 has a spout apparatus main unit 6 forming an internal flow path 6*a* for passing supplied water, a flow-conditioning apparatus 8 attached to the internal flow path 6*a* of the spout apparatus main unit 6, and a supply water pipe 10 for supplying water to the internal flow path 6*a* of the spout apparatus main unit 6. Also, the spout apparatus 2 comprises a body sensor (not shown) built into the tip portion of the spout apparatus main unit 6. This body sensor emits infrared and also serves as an infrared sensor for detecting objects by receiving infrared reflected off sensed objects.

As shown in FIG. 1, the spout apparatus main unit 6 is a tubular member made of metal; it extends mainly horizontally forward from wall surface W, and the front tip portion on which a spout portion is disposed is directed mainly downward. A spray member 16, described below, which is the tip portion of the spout apparatus main unit 6, is formed to have an approximately circular cross section. The supply water pipe 10 is connected to a cold water supply source for supplying cold water, or to a hot and cold mixing device or the like for mixing hot and cold water supplied from a cold water supply source and a hot water supply source.

In an embodiment of the invention thus constituted, the spout apparatus 2 of the present embodiment is constituted so that when a user places his or her fingers or the like under the spout portion, this is sensed by a body sensor (not shown), and a control apparatus (not shown) housed below the hand washing bowl 4 causes an electromagnetic valve (not shown) on the supply water pipe 10 to open. As a result, in the spout apparatus 2, cold water is supplied from the supply water pipe 10 through the internal flow path 6*a* to the flow-conditioning apparatus 8, and water which was flow-straightened in the flow-conditioning apparatus 8 is spouted in a shower form from the tip portion of the spout apparatus 2. Using the spout apparatus 2 of the present embodiment, the discharged shower-spouted water is a straight line flow with extremely high transparency. A beautiful linear form is preferably maintained in this shower discharge over a space of 80 mm or greater from the tip of the spout apparatus 2 (see FIG. 1) until water reaches the hands of a user placed over a hand washing bowl 4, for example.

Figure 3:
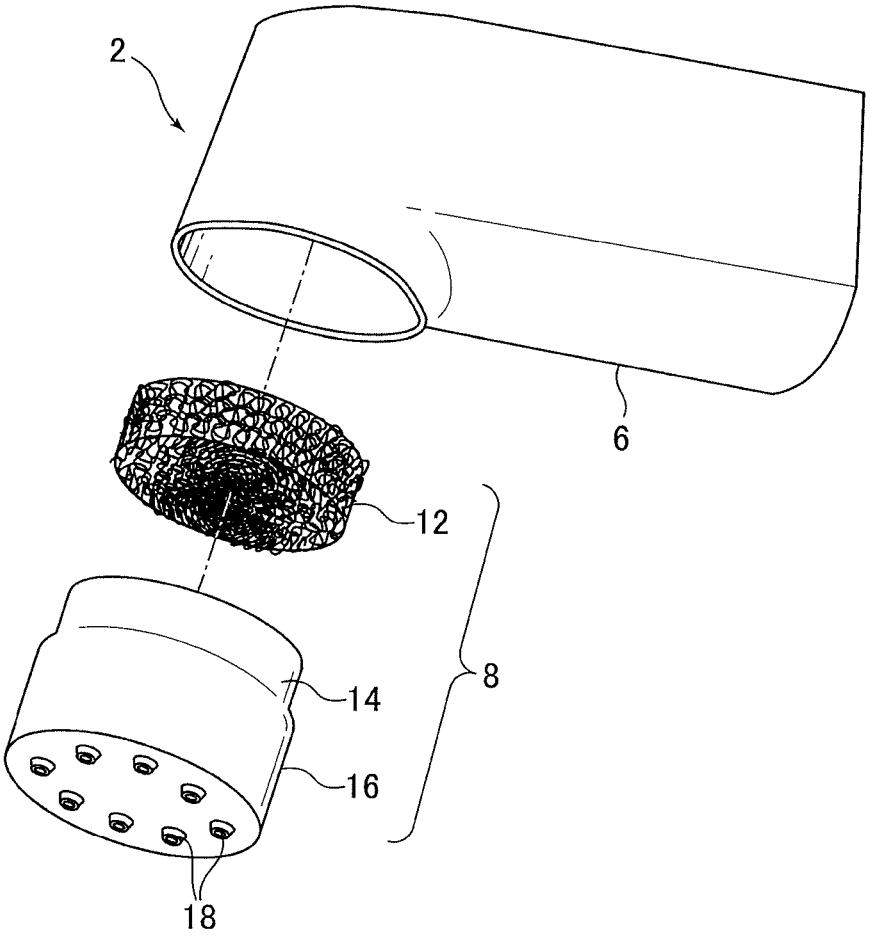
FIG. 3 is an exploded perspective view of a flow-conditioning apparatus built into the tip portion of a spout apparatus according to an embodiment of the invention.

Next, referring to FIGS. 2 through 5, the internal structure of a spout apparatus 2 in an embodiment of the invention is explained. FIG. 3 is an exploded perspective view of a flow-conditioning apparatus built into the tip portion of the apparatus according to an embodiment of the invention.

Figure 4:
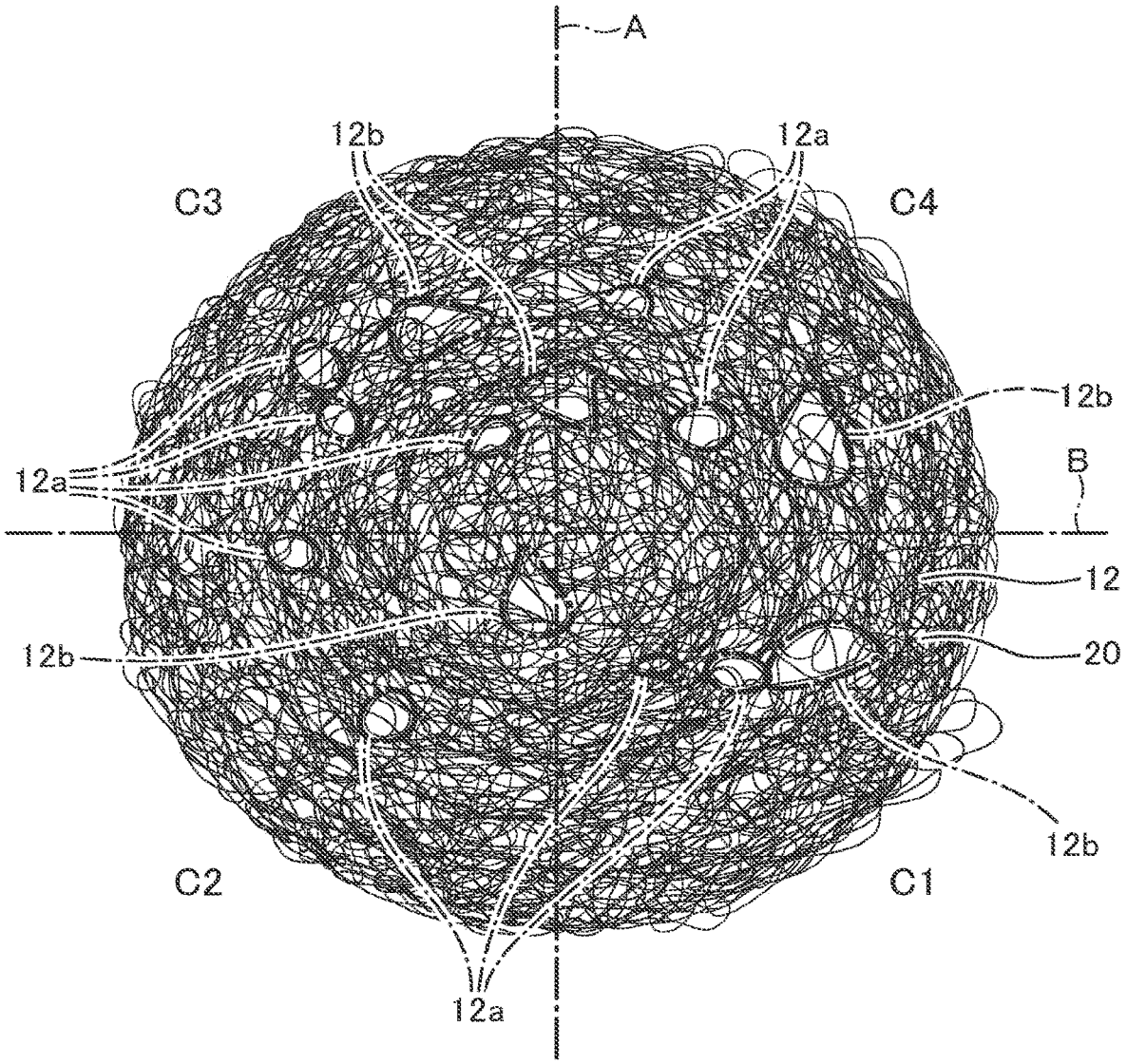
FIG. 4 is a top view of a mesh structure body in the FIG. 3 flow-conditioning apparatus.
Figure 5:
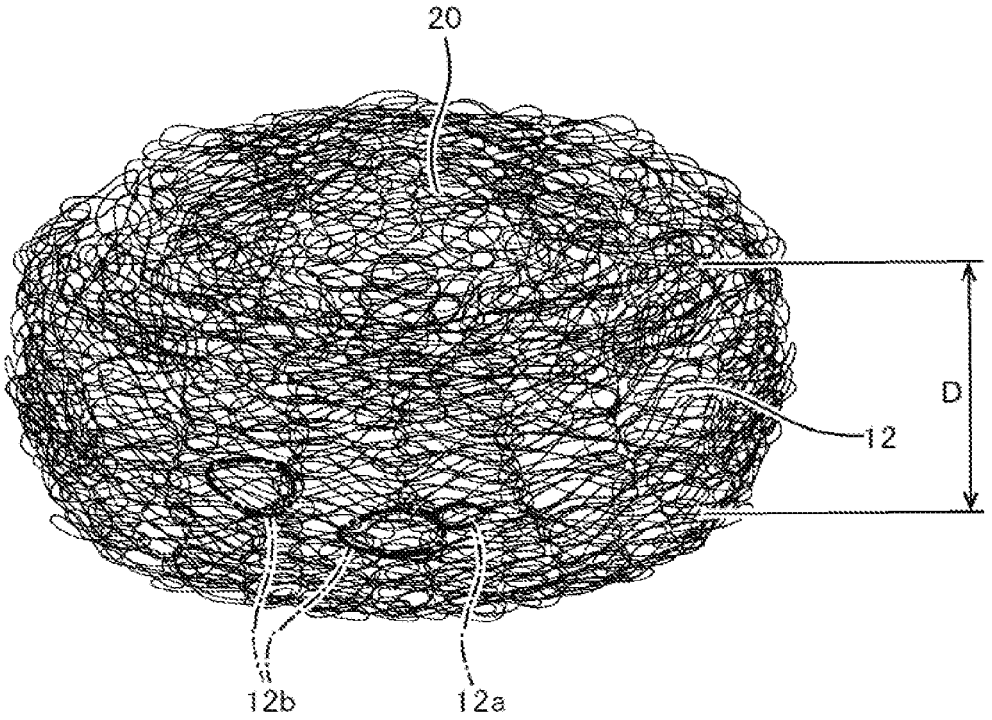
FIG. 5 is a perspective view of a mesh structure body in the FIG. 3 flow-conditioning apparatus.

FIG. 4 is a top view of a mesh structure body flow-conditioning apparatus in the FIG. 3. FIG. 5 is a perspective view of a mesh structure body in the FIG. 3 flow-conditioning apparatus. In FIGS. 4 and 5, for ease of understanding, a portion of the first holes 12*a* and second holes 12*b* in the mesh structure body 12 are shown by single dot and dash lines.

As shown in FIGS. 2 and 3, a flow-conditioning apparatus 8 is formed to match the shape of the tip opening portion at the tip portion of the spout apparatus main unit 6. The flow-conditioning apparatus 8, when attached to the spout apparatus main unit 6, constitutes an internal flow path contiguous with the internal flow path 6*a* of the spout apparatus main unit 6. The flow-conditioning apparatus 8, when attached to the spout apparatus main unit 6, constitutes the spout apparatus main unit 6. The flow-conditioning apparatus 8 has: a mesh structure body 12, being a flow-conditioning member formed in a columnar block shape; a flow-conditioning apparatus main unit 14 disposing the mesh structure body 12 interior thereof, and a spray member 16 on which multiple spray nozzles are formed, disposed on the downstream side of the mesh structure body 12.

The flow-conditioning apparatus main unit 14 is a resin member; a flow-conditioning chamber 14*a* with an approximately circular cross section is formed on the interior thereof. The flow-conditioning chamber 14*a* forms an internal flow path contiguous with the internal flow path 6*a*. The flow-conditioning chamber 14*a* has an approximately constant flow path cross section from the upstream end to the downstream end. The inside diameter of the flow-conditioning chamber 14*a* is essentially the same as the outside diameter of the mesh structure body 12, and the mesh structure body 12 is disposed over essentially the entirety of the interior of the flow-conditioning chamber 14*a*. The flow-conditioning apparatus main unit 14 is disposed to be contained within the tip portion of the spout apparatus main unit 6. The internal flow path 6*a* is connected to the upstream side of the flow-conditioning chamber 14*a*.

Multiple spray holes 18 for discharging water passed through the mesh structure body 12 are formed on the spray member 16. The spray holes 18 are formed with a tapered shape so that the flow path cross sectional area of the inside surfaces decreases toward their tip. The spray member 16 is connected to the flow-conditioning apparatus main unit 14. The spray holes 18 of the spray member 16 communicate with the downstream side of the flow-conditioning chamber 14*a*.

Figure 6:
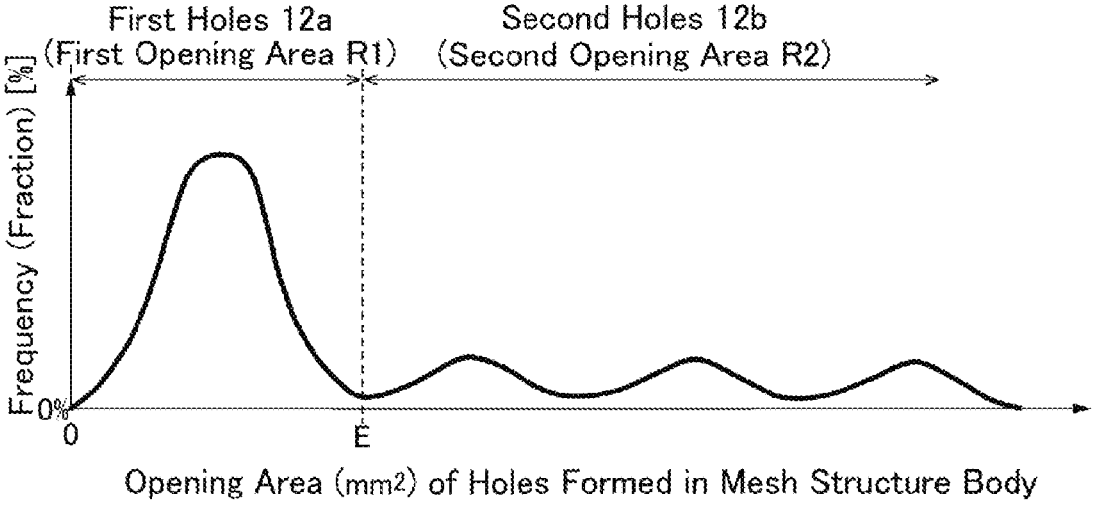
FIG. 6 is a diagram showing the results of measuring the frequency (ratio) of each of the number of first holes having a first opening area formed in a mesh structure in the FIG. 3, and the number of second holes having a second opening area greater than the first opening area, to the total number of holes.
Figure 10:
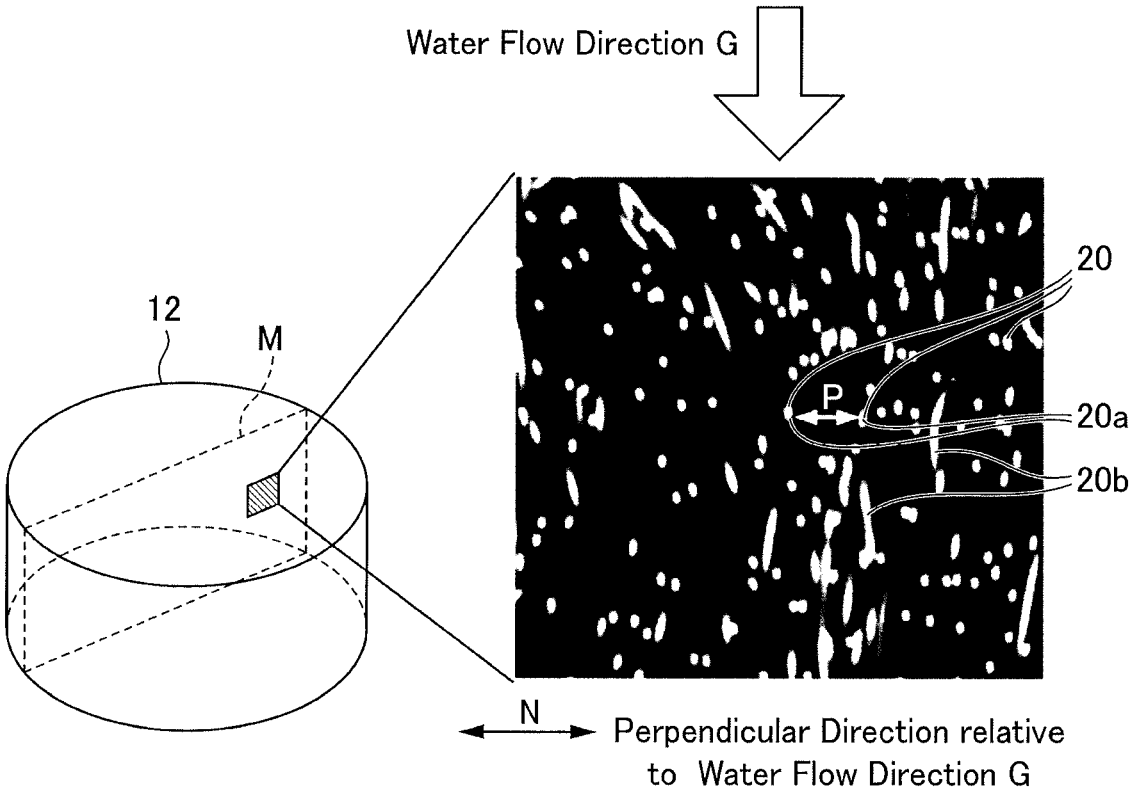
FIG. 10 is a diagram explaining a method for measuring the opening area and number of holes in the FIG. 2 mesh structure body.

Next, referring to FIGS. 3 through 6 and FIG. 10, the mesh structure body 12 in more detail is explained. FIG. 6 is a diagram showing the results of measuring the frequency (ratio) of each of the number of first holes 12*a* having a first opening area R1 formed in a mesh structure in the FIG. 3, and the number of second holes 12*b* having a second opening area R2 greater than the first opening area R1, to the total number of holes, FIG. 10 is a diagram explaining a method for measuring the opening area and number of holes mesh structure portion in the FIG. 2. The mesh structure body 12 is formed by metal wire 20. The mesh structure body 12 is a structure with a relatively dense mesh structure portion in not only the direction perpendicular to the water flow direction G (see FIG. 2), but also in the water flow direction G. The water flow direction G is the direction in which the flow path of the flow-conditioning chamber 14*a* extends. The mesh structure body 12 is, for example, Accumesh [brand name]. The mesh structure body 12 is formed in a cylindrical shape. I.e., the mesh structure body 12 is formed to have a constant thickness D from the upstream end toward the downstream end of the flow-conditioning chamber 14*a*. The mesh structure body 12 has a thickness greater than that of a mesh body in a single sheet form. The mesh structure body 12 is disposed so that its top surface is approximately perpendicular to the water flow direction G within the flow-conditioning chamber 14*a* (see FIG. 2). The mesh structure body 12 placed in the flow path, has the function of causing the flow velocity distribution of water passing through the mesh structure body 12 to become uniform over the entire flow path, thereby conditioning its flow. The mesh structure body 12 is formed of resin wire 20.

As shown in FIGS. 4 through 6, in the mesh structure body 12, first holes 12*a* having a first opening area R1 and second holes 12*b* having a second opening area R2 greater than that of first opening area R1 are formed in the mesh openings created by the metal wire 20. Seen in plan view, in the mesh structure body 12 second holes 12*b* are formed over the each of the four divided areas C1 through C4 (the all of the four divided areas C1 through C4), which are divided into two equal left and right parts of the mesh structure body 12 by a first center line A and into two equal front and back parts of the mesh structure body 12 by a second center line B. The first holes 12*a* and second holes 12*b* are all divided by a metal wire 20 in a cross section either parallel or perpendicular to the direction of water flow G.

FIG. 6 shows the frequency (ratio) [%] of the number of holes having a certain opening area in the vertical axis to the total number of holes, and shows the hole opening area ($mm^2$) of holes formed in the mesh structure body 12 in a cross section parallel to the water flow direction G in the horizontal axis. Measurement of the hole opening area and number of holes as shown in FIG. 6 is performed by using an X-ray CT device. The X-ray CT captures an image of a cross section (plane) parallel to the water flow direction G in the mesh structure body 12, then The X-ray CT conducts image-processing about this captured image. Measurement of the opening area and number of holes may also be conducted by image capture of the cross section (plane) perpendicular to the water flow direction G in the mesh structure body 12 using an X-ray CT device. In the present embodiment, FIG. 10 shows an expanded view of a portion of an image captured by an X-ray CT device of a cross section M parallel to the water flow direction G. The cross section M captured image includes a cross section 20*a* and side elevation 20*b* of the metal wire 20. The distance P between cross sections 20*a* of the wire 20 in a direction N perpendicular to the water flow direction G can be obtained from this captured image. The opening area of the hole is calculated by viewing this distance P as the hole diameter. Note that the hole opening area may also be calculated based on the distance P between cross sections 20*a* in a different direction. Thus in a cross section M parallel to water flow direction G, the hole opening area is calculated, and the number of holes with a given opening area is also measured by counting the number of holes (holes between cross sections 20*a* in the metal wire 20) from the captured image. In addition, to reduce the effect of localized bias of holes due to the position of the cross section M, multiple images of the cross sections M parallel to the water flow direction G are captured, and the number of times that the distance P is obtained, i.e., the number of times that the hole opening area is calculated, is increased to a predetermined count or, within the captured image of a cross section M, the number of times that the distance P is obtained, i.e., the number of times that the hole opening area is calculated, is increased to a predetermined number. For example, the predetermined number of times that the distance P is obtained is 60 or greater. Note that in FIG. 10, the side surfaces 20*b* of the metal wire 20 extend in a direction parallel to the water flow direction G. I.e., FIG. 10 shows the appearance that the side surfaces 20*b* of metal wire 20, which is the mesh structure portion 24 forming at least a part of the mesh structure body 12, extends in a direction parallel to the water flow direction G.

First holes 12*a* have a first opening area R1 equal to or less than opening area E. Second holes 12*b* have a second opening area R2 greater than the opening area E. The opening area E forming a boundary is set from 0.2 $mm^2$ to 0.4 $mm^2$, and preferably from 0.3 $mm^2$ to 0.4 $mm^2$, and more preferably to 0.35 $mm^2$. By such a setting, for example, the first opening area R1 is set to an opening area larger than 0 $mm^2$ and less than or equal to 0.4 $mm^2$. As shown in FIGS. 4 and 5, the number of second holes 12*b* in the mesh structure body 12 is less than the number of first holes 12*a*. The number of second holes 12*b* is also fewer than the number of first holes 12*a* when seen in plan view. In FIG. 6, as well, the total fraction of the number of second holes 12*b* is smaller than the total fraction of the number of first holes 12*a*.

Figures 7A, 7B, 7C, 7D:
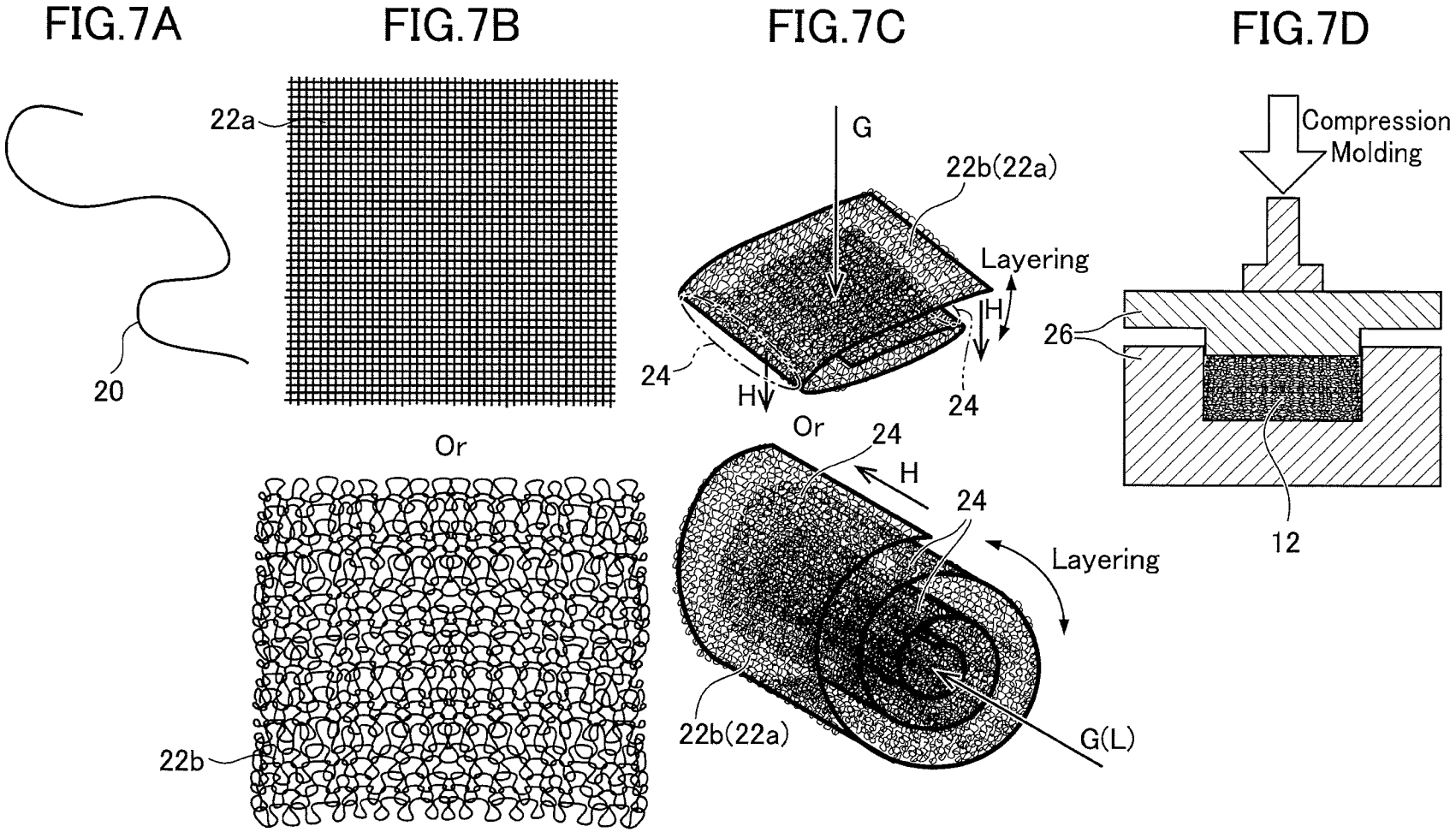
FIG. 7A is a diagram explaining a method for manufacturing the mesh structure body in the spout apparatus of an embodiment of the invention.
FIG. 7B is a diagram explaining a method for manufacturing the mesh structure body in the spout apparatus of an embodiment of the invention.
FIG. 7C is a diagram explaining a method for manufacturing the mesh structure body in the spout apparatus of an embodiment of the invention.
FIG. 7D is a diagram explaining a method for manufacturing the mesh structure body in the spout apparatus of an embodiment of the invention.

Next, referring to FIGS. 1, 2, 7, etc., a method for manufacturing a spout apparatus 2 in an embodiment of the invention is explained. FIG. 7A-7D are a diagram explaining a method for manufacturing the mesh structure portion in the spout apparatus of an embodiment of the invention. In the manufacturing method of the spout apparatus 2, a step to prepare a spout apparatus main unit 6 forming an internal flow path 6*a* is executed. A step to prepare the mesh structure body 12 for conditioning (uniforming) the flow velocity distribution of supplied water is also executed in order to place in the internal flow path 6*a* inside this spout apparatus main unit 6. A step is also executed to prepare spray member 16, in which multiple spray holes 18 for spouting water which has passed through this mesh structure body 12 are formed. These steps may be executed in any desired order. After executing and completing these steps, a step is executed in which the mesh structure body 12 is placed in the internal flow path 6*a* of the spout apparatus main unit 6, and a spray member 16 is attached to the spout apparatus main unit 6 to form the spout apparatus 2.

Next, referring to FIG. 7, the step for preparing the mesh structure body 12 is explained in more detail. The mesh structure body 12 preparation step includes a manufacturing method for the mesh structure body 12. As shown in FIG. 7A, in the manufacturing method of the mesh structure body 12, a step to prepare the metal wire 20 which forms the mesh structure body 12 is first executed. The metal wire 20 is, for example, a stainless steel wire. As shown in the top portion of FIG. 7B, a step to form a thin plate-shaped mesh sheet (metal mesh) 22*a* is executed, and as shown in the bottom portion of FIG. 7B, a step to form a fabric mesh sheet 22*b* is executed. As shown in the upper portion of FIG. 7B, following the step to prepare, a step to form a thin plate-shaped mesh sheet (metal mesh) 22*a* by weaving the metal wire 20 in a crisscross pattern is executed. Or, as shown in the lower portion of FIG. 7B, following the step to prepare a step to form a fabric mesh sheet 22*b* by knitting the metal wire 20 in a crisscross pattern is executed. The fabric mesh sheet 22*b* forms a thin plate-shaped sheet with approximately the thickness of towel fabric. These mesh sheets 22*a*, 22*b* form a mesh structure forming numerous fine holes by their mesh openings.

The wire diameter of the metal wire 20 in the mesh sheets 22*a*, 22*b* is finer than that of the metal wire for flow-conditioning mesh in a conventional spout apparatus (e.g., 180 μm).

Next, as shown in FIG. 7C, after the step forming a mesh sheet, a step for laying (folding) the mesh sheet is executed. One of either of mesh sheets 22*a*, 22*b* is selected and the mesh sheet layering step is executed. In the step layering the mesh sheet, the mesh sheets 22*a*, 22*b* is layered such that at least a portion of the mesh structure portion 24 in the mesh sheets 22*a*, 22*b* extends in a direction parallel to the water flow direction G. The water flow direction G is the direction in which water flows into the mesh structure body 12 after it is formed. As shown in FIG. 2, the water flow direction G is the direction from the upstream end to the downstream end of the flow-conditioning chamber 14*a*, and is the direction of the thickness D of the mesh structure body 12 after it is formed. The water flow direction G is also exemplified in FIG. 7C. A step of layering is accomplished either by a folding step to fold the mesh sheet 22*b* (22*a*) as shown in the upper portion of FIG. 7C, or by a winding step to wind the mesh sheet 22*b* (22*a*) into a roll shape as shown in the lower portion of FIG. 7C. As shown in the upper portion of FIG. 7C, when the mesh sheet 22*b* (22*a*) is folded so as to form folded portions, the mesh structure portion 24 at the folded portions is layered so as to extend in a direction H parallel to the water flow direction G. In the upper portion of FIG. 7C, the mesh structure portion 24 at the layered portion is surrounded by a double dot and dash line. As shown in the lower portion of FIG. 7C, when the mesh sheet 22*b* (22*a*) is layered by winding into a roll shape, the layering is done so that essentially the entire mesh structure portion 24 of the mesh sheets 22*a*, 22*b* extends in a direction H parallel to the water flow direction G. In the lower portion of FIG. 7C, the mesh structure portion 24 is essentially the entirety of the mesh sheets 22*a*, 22*b*, therefore the reference numeral of the mesh structure portion 24 indicates portion on the mesh sheets 22*a*, 22*b*.

Next, as shown in FIG. 7D, following the step for layering the mesh sheet, a step is executed to form the mesh structure body 12 by three-dimensionally molding the layered mesh sheet. The layered mesh sheets 22*a*, 22*b* are placed in a press 26 and compression molded by the press 26. A cylindrical mesh structure body 12 (see FIG. 5) is formed by compression molding (forming) using the press 26. More specifically, the mesh structure body 12 is formed by compression molding of the mesh sheets 22*a*, 22*b*, layered as shown in the upper portion of FIG. 7C, so that they are oriented in the same direction as the water flow direction G (the direction in which the folded mesh sheets 22*a*, 22*b* are pressed from their upper surface in a field sate). Alternatively, the mesh structure body 12 is formed by compression molding the mesh sheets 22*a*, 22*b*, layered as shown in the lower portion of FIG. 7C, along the axial direction L of these roll-shaped mesh sheets 22*a*, 22*b* (the same direction as water flow direction G). At this point the rolled mesh sheets 22*a*, 22*b* are crushed and molded in the axial direction L. By compression molding the rolled mesh sheets 22*a*, 22*b* in the axial direction L, the mesh sheets 22*a*, 22*b* can be molded to spread out in a relatively uniform manner in the radial and circumferential directions. Thus the mesh structure body 12 is formed by molding the mesh sheets 22*a*, 22*b* so that at least a portion of the mesh structure portion 24 of the mesh sheets 22*a*, 22*b* is formed in a layered and three dimensional manners so as to extend in a direction H parallel to the flow direction G of inflowing water. Thus the mesh structure body 12 comprises a mesh structure portion 24 extending in a direction parallel to the water flow direction G of inflowing water. Also, even if the size of the respective meshes in the mesh sheets 22*a*, 22*b* are essentially uniform before molding, at least two types of holes, being first holes 12*a* and second holes 12*b*, are formed in the mesh structure body 12 by compression molding.

Figure 8:
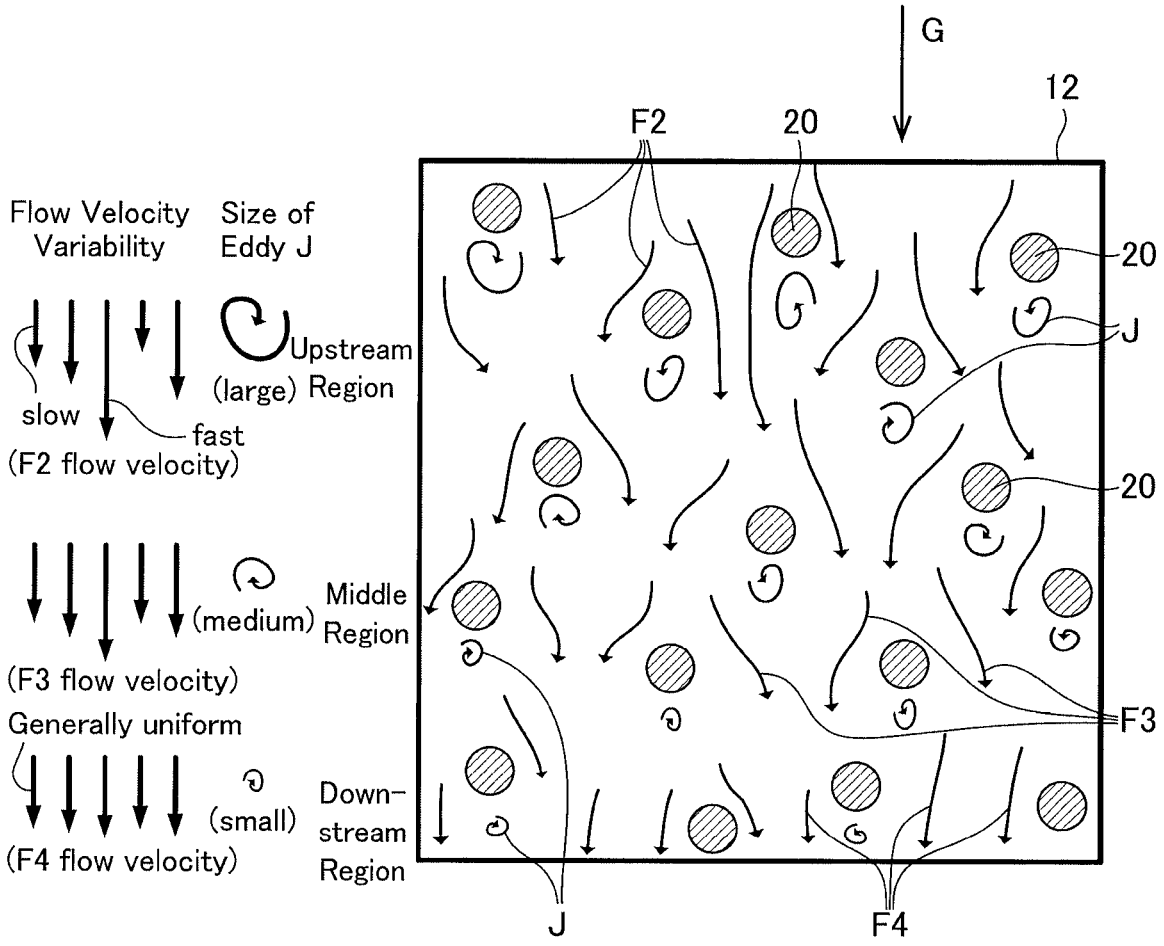
FIG. 8 is a diagram showing an expanded view of a cross section of the FIG. 2 mesh structure body, wherein the distribution of flow velocities of water flowing into the mesh structure portion is made uniform.
Figure 9:
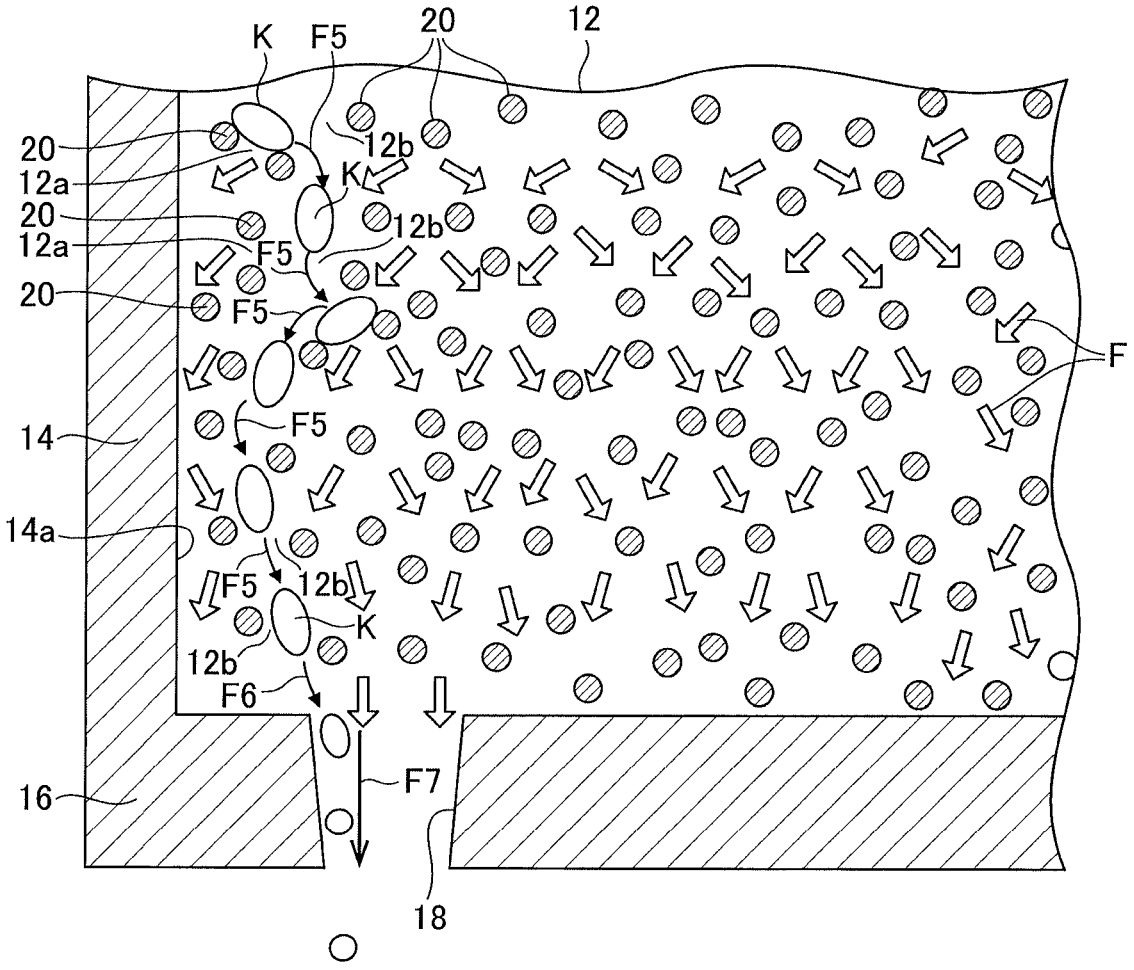
FIG. 9 is a diagram showing an expanded cross section of the mesh structure body in FIG. 2 and explaining the way in which air bubbles emerge from the mesh structure body.

Next, referring to FIGS. 2, 8 and 9, the effect of a spout apparatus according to an embodiment of the invention is explained. FIG. 8 is a diagram showing an expanded view of a cross section of mesh structure portion in the FIG. 2, and explaining a state that the distribution of flow velocities of water flowing into the mesh structure portion is made uniform. FIG. 9 is a diagram showing an expanded cross section of the mesh structure portion in FIG. 2 and explaining the way in which air bubbles emerge from the mesh structure portion. FIG. 9 shows, by arrow F, the direction of water flow.

Prior to initial use of the spout apparatus 2, the interior of the flow-conditioning chamber 14*a* in the flow-conditioning apparatus 8 is filled with air. As shown by arrow F1 in FIG. 2, when water is supplied to the flow-conditioning apparatus 8 in order to start spouting water from the spout apparatus 2, water flows into the flow-conditioning chamber 14*a* from the internal flow path 6*a*. Water flowing into the flow-conditioning chamber 14*a* flows into the mesh structure body 12 in approximately the direction of water flow direction G. As shown by arrow F2 in FIG. 8, the flow of water flowing into the mesh structure body 12 repeatedly diffuses, separates, and merges over a relatively short distance as it passes through the mesh holes of metal wire 20. This results in flow-conditioning so that, as a whole, the distribution of flow velocities is efficiently made uniform. I.e., the mesh structure body 12 has a relatively high density mesh opening structure over a certain thickness D in the water flow direction G, therefore water efficiently passes multiple times through first holes 12*a* or second holes 12*b* in the mesh. At this point, as shown by arrow F3, water is separated multiple times in two directions by the metal wire 20 as it passes through the mesh structure body 12, so that overall uniformization of flow velocity distribution is promoted. As shown by arrows F2 through F4, from the upstream region to the downstream region of the mesh structure body 12, the variability of water flow velocity is made gradually uniform, and in the downstream region the flow velocity distribution is for the most part uniform. Therefore the mesh structure body 12 can provide a higher flow-conditioning effect than achieved with a conventional flow-conditioning mesh placement, even when formed to be relatively compact. As shown by arrow F4, in water flowing out from the mesh structure body 12, the overall flow velocity distribution at the downstream end of the mesh structure body 12 is generally made uniform.

As shown by arrow F2, water collides with metal wire 20 when flowing into the mesh structure body 12, and may produce eddies J on the rear side of the metal wire 20 due to the circular flow of water around the back side of the metal wire 20. In the present embodiment the diameter of the metal wire 20 is relatively fine. Therefore, the amount of water making a circular flow around the back of the metal wire 20 is reduced, and eddies J are also formed relatively small in the upstream region of the mesh structure body 12. The ability to form the eddies J relatively small enables disordering of the flow velocity distribution caused by the formation of eddies J to be suppressed. Also, by forming the eddies J relatively small, the eddies become like a wall to the flow of water, so impediments to uniformization of flow velocity distribution can be suppressed. In addition, from the upstream region to the downstream region of the mesh structure body 12, the flow velocity distribution is made uniform, and the size of the eddies J becomes gradually smaller. Hence disordering of the flow velocity distribution due to the formation of eddies J can be suppressed.

As described above, when a relatively fine wire diameter is used for the metal wire 20 in order to make eddies J relatively small, it may occur that the metal wire 20 strength diminishes so that the ability of the metal wire 20 to withstand water pressure and resist deformation is degraded. In response, as shown in FIGS. 5 and 7C, at least a portion of the mesh structure portion 24 of the mesh sheets 22*a*, 22*b* is disposed to extend in a direction parallel to water flow direction G. The mesh structure portion 24 of the mesh structure body 12 thus has a large number of cylindrical structures (bridging structures between wires) in water flow direction G. Therefore, the mesh structure portion 24 of the mesh structure body 12 can resist inflowing water pressure even if the wire diameter of the metal wire 20 in the mesh structure body 12 is made relatively fine. In addition, the mesh structure portion 24 allows the water pressure resistance force of the mesh structure body 12 to be increased, and deformation of the mesh structure body 12 to be suppressed.

As shown in FIG. 9, when water collides with the mesh structure body 12, air dissolved in the water is deposited as bubbles, and the joining together of bubbles sometimes forms larger bubbles K. First holes 12*a* and second holes 12*b* are formed on the mesh structure body 12. As shown by arrow F5, the relatively large bubbles K cannot easily pass through the first holes 12*a* but can easily pass through the second holes 12*b*. The second holes 12*b* are formed roughly at a proportion such that they are present in any cross section of the mesh structure body 12. The bubbles K are able to move to the downstream side while passing through the second holes 12*b*. As shown by arrow F6, the bubbles K are able to emerge from the mesh structure body 12 by passing through the second holes 12*b*. Relatively large sized bubbles K accumulate inside the mesh structure body 12. Therefore, relatively large sized bubbles K can act as a wall and thereby suppress impediments to uniformization of flow velocity distribution.

Next, as shown by arrow F7 in FIG. 2 and FIG. 9, water reaching the spray member 16 is sprayed out of each spray hole 18. Water reaching the spray member 16 is fully flow uniformed by the mesh structure body 12, and its flow vectors are highly equalized. Therefore, hot and cold water sprayed from each of the spray holes 18 flows in straight lines with extremely high flow alignment and transparency. Over a space of 80 mm or greater from the tip of the spout apparatus 2 until water reaches the hands of a user placed over a hand washing bowl 4, for example, division of this hot or cold water into droplets is suppressed.

According to the spout apparatus 2 according to an embodiment of the invention, the mesh structure body 12 is formed so that at least a part of the mesh structure portion 24 of the mesh sheet 22*a*, 22*b* is formed to extend in a direction parallel to the water flow direction G in which water flows into the mesh structure body 12. The mesh structure portion 24 of the mesh sheet 22*a*, 22*b* in the mesh structure body 12 can thus resist the pressure of water flowing into the mesh structure portion 24, and the withstand force of the mesh structure body 12 to water pressure can be increased. Also, the mesh structure body 12 is formed by layering and three dimensionally molding the mesh sheets 22*a*, 22*b* in which numerous fine holes are formed. By this means the water is flow straightened as it efficiently passes multiple times through the mesh sheets 22*a*, 22*b* over a relatively short distance within the mesh structure body 12 even if the mesh structure body 12 is compactly constituted, and flow velocity distribution can be made uniform. Therefore, in the embodiment of the invention, even when the mesh structure body 12 is formed of fine diameter mesh sheets 22*a*, 22*b*, the mesh structure portion 24 within the mesh structure body 12 can be suppressed from sagging under water pressure, the mesh structure body 12 can be compactly constituted, and flow velocity distribution can be made uniform.

When the mesh sheets 22*a*, 22*b* are folded and molded, the mesh sheets 22*a*, 22*b* of mesh structure portion 24 is formed to extend in a direction parallel to water flow direction G at the tip portion of the mesh structure body 12. At this point, because the tip portion of the mesh structure body 12 has a mesh structure portion 24 resistant to water pressure, withstand force to water pressure increases. At the same time, the center portion of the mesh structure body 12 does not have a mesh structure portion 24 resistant to water pressure, therefore withstand force to water pressure is low. In the embodiment of the invention, compression molding is performed after layering the mesh sheets 22*a*, 22*b* into a roll shape. Therefore, a mesh structure portion 24 resistant to water pressure is formed not only at the tip portions of the mesh structure body 12 but also at the center portion thereof. This enables the strength of water pressure resistance to also be increased in the center portion of the mesh structure body 12. In addition, when layering the mesh sheets 22*a*, 22*b* in a roll shape, the problem arises that the thickness of the layered mesh sheets 22*a*, 22*b* is greater as compared to folding the mesh sheets 22*a*, 22*b*. In the embodiment of the invention, compression molding the mesh sheets 22*a*, 22*b* after layering them in a roll shape enables the mesh structure body 12 to be compactly constituted.

Also, according to the spout apparatus 2 according to the present embodiment, the rolled mesh sheets 22*a*, 22*b* are compression molded in the axial direction L of these mesh sheets 22*a*, 22*b*. By this means, the mesh structure portions 24 of the numerous mesh sheet 22*a*, 22*b* are formed to extend in a direction parallel to the inflowing water flow direction G. The mesh structure portion 24 of the mesh sheet 22*a*, 22*b* in the mesh structure body 12 can resist the pressure of water flowing into the mesh structure portion 24, and the withstand force of the mesh structure body 12 to water pressure can be further increased.

The inventors of the invention discovered a new problem, whereby when water collides with a mesh structure body 12, air which had been dissolved in the water, although small in volume, is deposited to form bubbles, bubbles combine to form large bubbles, and large bubbles sticking to the mesh structure body 12 disturb the flow velocity distribution. If the size of bubbles in the mesh structure body 12 equals or exceeds that of holes formed in the mesh structure body 12, the bubbles become like a wall in the mesh structure body 12 and continue to accumulate, thereby obstructing the uniformization of water flow. According to a spout apparatus 2 according to the present embodiment, first holes 12*a* having a first opening area R1 and second holes 12*b* having a second opening area R2 greater than that of first opening area R1 are formed in the mesh structure body 12. The bubbles K which could not pass through first holes 12*a* can pass through second holes 12*b*. Lodging of relatively large air bubbles K in the mesh structure body 12 can thus be constrained from impeding the uniformization of flow velocity distributions.

According to the spout apparatus 2 according to the present embodiment, in each of the four divisional regions C1 through C4 of mesh structure body 12, bubbles K which did not pass through the first holes 12*a* are able to pass through the second holes 12*b*. Lodging of relatively large air bubbles K in the mesh structure body 12 can thus be further constrained from impeding the uniformization of flow velocity distributions.

According to the spout apparatus 2 of the present embodiment, the number of second holes 12*b* is fewer than the number of first holes 12*a*, therefore more of the water passing through the mesh structure body 12 passes through the small opening area first holes 12*a*, and the flow velocity of at least a portion of the water passing through the first holes is slowed. This enables the flow velocity distribution to be more easily made uniform.

Also, According to the spout apparatus 2 according to the present embodiment, the mesh structure body 12 is formed so that at least a part of the mesh structure portion 24 of the mesh sheet 22*a*, 22*b* is formed to extend in a direction parallel to the water flow direction G in which water flows into the mesh structure body 12. The mesh structure portion 24 of the mesh sheet 22*a*, 22*b* in the mesh structure body 12 can thus resist the pressure of water flowing into the mesh structure portion 24, and the withstand force of the mesh structure body 12 to water pressure can be increased. Also, the mesh structure body 12 is formed by layering and three dimensionally molding the mesh sheets 22*a*, 22*b*, in which numerous fine holes are formed. Thus even if the mesh structure body 12 is compactly constituted, the water flow is uniformed as water flow efficiently passes multiple times through the mesh sheets 22*a*, 22*b* over a relatively short distance within the mesh structure body 12, and flow velocity distribution can be made uniform. Therefore, according to the embodiment of the invention, even when the mesh structure body 12 is formed of fine diameter mesh sheets 22*a*, 22*b*, the mesh structure portion 24 within the mesh structure body 12 can be suppressed from sagging under water pressure, the mesh structure body 12 can be compactly constituted, and flow velocity distribution can be made uniform.

What is claimed is:

1. A spout apparatus, comprising:

a spout apparatus main body having an inner wall forming a flow path for passing a flow of water supplied thereto;

a flow-conditioning member disposed on the flow path of the spout apparatus main body for conditioning a distribution of flow velocities of the flow of water; and a spray member configured with spray holes to spout the flow of water passed through the flow-conditioning member in a shower form;

wherein the flow-conditioning member is formed by a single fabric mesh sheet overlapped along a direction of the flow of water flowing into the flow-conditioning member, and a wire of at least a portion of the single fabric mesh sheet in the flow-conditioning member extends in a direction parallel to the direction of the flow of water flowing into the flow-conditioning member;

wherein the single fabric mesh sheet forms a contact surface extending along the inner wall; and wherein the flow-conditioning member is compressed along the direction of the flow of water flowing into the flow-conditioning member.

2. The spout apparatus of claim 1, wherein first holes having a first opening area and second holes having a second opening area larger than the first opening area are formed in the flow-conditioning member.

3. The spout apparatus of claim 2, wherein in plane view, the second holes are formed in each of four divided areas of the flow-conditioning member, which is divided by a first center line dividing equally the flow-conditioning member into a left part and a right part and by a second center line dividing equally the flow-conditioning member into a front part and a back part.

4. The spout apparatus of claim 3, wherein a number of the second holes is smaller than a number of the first holes.

* * * * *